US011668151B2

(12) United States Patent
Bourgeois et al.

(10) Patent No.: US 11,668,151 B2
(45) Date of Patent: Jun. 6, 2023

(54) TUBING HEAD SPOOL WITH ADAPTER BUSHING

(71) Applicant: FMC Technologies, Inc., Houston, TX (US)

(72) Inventors: Jeff Bourgeois, Houston, TX (US); Ian Mcclymont Davidson, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 17/470,353

(22) Filed: Sep. 9, 2021

(65) Prior Publication Data

US 2023/0076356 A1 Mar. 9, 2023

(51) Int. Cl.
*E21B 33/038* (2006.01)
*E21B 19/22* (2006.01)

(52) U.S. Cl.
CPC ..... *E21B 33/038* (2013.01); *E21B 19/22* (2013.01)

(58) Field of Classification Search
CPC ..... E21B 33/038; E21B 19/22
See application file for complete search history.

(56) References Cited

U.S. PATENT DOCUMENTS 3,489,213 A * 1/1970 Hutchison ..... E21B 33/038 166/348
3,848,898 A * 11/1974 De Panafieu ..... E21B 33/038 285/317
5,638,903 A * 6/1997 Kent ..... E21B 33/038 166/348
6,012,519 A 1/2000 Allen et al.
7,798,231 B2 9/2010 Ford
2008/0006412 A1* 1/2008 Ford ..... E21B 33/035 166/368
2009/0211749 A1 8/2009 Nguyen et al.
2010/0288503 A1* 11/2010 Cuiper ..... E21B 33/038 285/308

(Continued)

FOREIGN PATENT DOCUMENTS

EP 0334389 A2 9/1989
WO 2020/206394 A1 10/2020

OTHER PUBLICATIONS

International Search Report issued in International Application No. PCT/US2022/037066, dated Oct. 17, 2022 (7 pages).

(Continued)

*Primary Examiner* — James G Sayre
(74) *Attorney, Agent, or Firm* — Osha Bergman Watanabe & Burton LLP

(57) ABSTRACT

Apparatus and methods provide for a tubing head spool that may be disposed in a wellhead during drilling or other wellbore operations, after which a tubing hanger adapter may be disposed within the tubing head spool for hanging tubing. Methods include installing a tubing head spool onto a wellhead, installing a blow out preventer onto the tubing head spool, drilling a well by running downhole tools and at least one casing string through the tubing head spool, running a tubing hanger adapter bushing through the blow out preventer and into the tubing head spool, running a tubing string into the well, and landing out the tubing string using a tubing hanger configured to hang within the tubing hanger adapter bushing.

8 Claims, 6 Drawing Sheets

(56) References Cited

U.S. PATENT DOCUMENTS

| | | | | |
|---|---|---|---|---|
| 2013/0248196 | A1* | 9/2013 | Gette | E21B 33/03 166/348 |
| 2015/0315869 | A1 | 11/2015 | Landry | |
| 2016/0123103 | A1* | 5/2016 | Puccio | E21B 33/038 166/75.11 |
| 2017/0183932 | A1* | 6/2017 | Cotton | E21B 33/038 |
| 2018/0163491 | A1 | 6/2018 | Nguyen et al. | |

OTHER PUBLICATIONS

Written Opinion issued in International Application No. PCT/US2022/037066, dated Oct. 17, 2022 (9 pages).

* cited by examiner

TUBING HEAD SPOOL WITH ADAPTER BUSHING

BACKGROUND

In the petroleum industry, hydrocarbons are located in porous rock formations far beneath the Earth's surface. Wells are drilled into these formations to provide access to and produce said hydrocarbons. Wells are built by drilling various hole sections each of decreasing size. Each hole section has a casing string that supports the hole structure and isolates formation fluids within the various underground formations. A casing string is made of a plurality of about 40 ft long joints of casing that are threaded together at the surface. Once the entire length of casing, for each casing string, has been tripped into the hole section, the casing must be "landed out" at the surface.

A casing string is landed out using a casing hanger that is designed to fit and seal within a wellhead located at the surface of the Earth. The wellhead is able to support the entire weight of the casing string. The wellhead also provides access to the various annuli between casing strings and wellbore walls. A well may include anywhere from 1-5 different hole sizes each with their own casing string and casing hanger located in the wellhead. After the last hole section has been drilled and the last casing string has been "landed out" and cemented in place, the well undergoes a completion operation.

Oftentimes, the completion operation includes running a tubing string into the completed well. A tubing string is tripped into the innermost casing string to provide a conduit for the hydrocarbons to travel from the formation to the surface of the Earth. The tubing string is made of a plurality of about 30 ft long joints of tubing that are smaller in diameter compared to the casing string(s). A tubing string may also include various pieces of equipment that are used to aid in the production of hydrocarbons from the porous rock formation. A tubing string must also be "landed out" at the surface using a tubing hanger. The tubing hanger is landed out in a tubing head that is installed on top of the wellhead.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present invention presents, in one or more embodiments, apparatuses and methods for a tubing head adapter bushing and a tubing head spool for installation on a wellhead. In one or more embodiments, the apparatus includes a tubing head spool, a tubing hanger adapter bushing, a lock ring mechanism, and a first hang off mechanism. The tubing head spool has an inner circumferential surface, a first lateral end that forms a wellhead connection with the wellhead, and a second lateral end.

The tubing hanger adapter bushing has an outer circumferential surface and a tubing head interface, where the outer circumferential surface is sized to fit within the tubing head spool. The first hang off mechanism has a hang off ring seat located circumferentially within the inner circumferential surface of the tubing head spool and a hang off ring disposed circumferentially around the outer circumferential surface of the tubing hanger adapter bushing. The lock ring mechanism has a lock ring interface machined into the inner circumferential surface of the tubing head spool and a lock ring disposed circumferentially around the outer circumferential surface of the tubing hanger adapter bushing.

In other embodiments, the apparatus includes a tubing head spool, a tubing hanger adapter bushing, a lock ring mechanism, and a second hang off mechanism. The tubing head spool has an inner circumferential surface, a first lateral end that forms a wellhead connection with the wellhead, and a second lateral end. The tubing hanger adapter bushing has an outer circumferential surface and a tubing head interface, where the outer circumferential surface is sized to fit within the tubing head spool.

The second hang off mechanism has load shoulders fixed circumferentially within the inner circumferential surface of the tubing head spool, a load ring disposed circumferentially around the outer circumferential surface of the tubing hanger adapter bushing, and a retainer sleeve disposed circumferentially around the outer circumferential surface of the tubing hanger adapter bushing. The lock ring mechanism has a lock ring interface machined into the inner circumferential surface of the tubing head spool and a lock ring disposed circumferentially around the outer circumferential surface of the tubing hanger adapter bushing.

The method includes installing a tubing head spool onto a wellhead, installing a blow out preventer onto the tubing head spool, drilling a well by running downhole tools and at least one casing string through the tubing head spool, running a tubing hanger adapter bushing through the blow out preventer and into the tubing head spool, running a tubing string into the well, and landing out the tubing string using a tubing hanger configured to hang within the tubing hanger adapter bushing.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
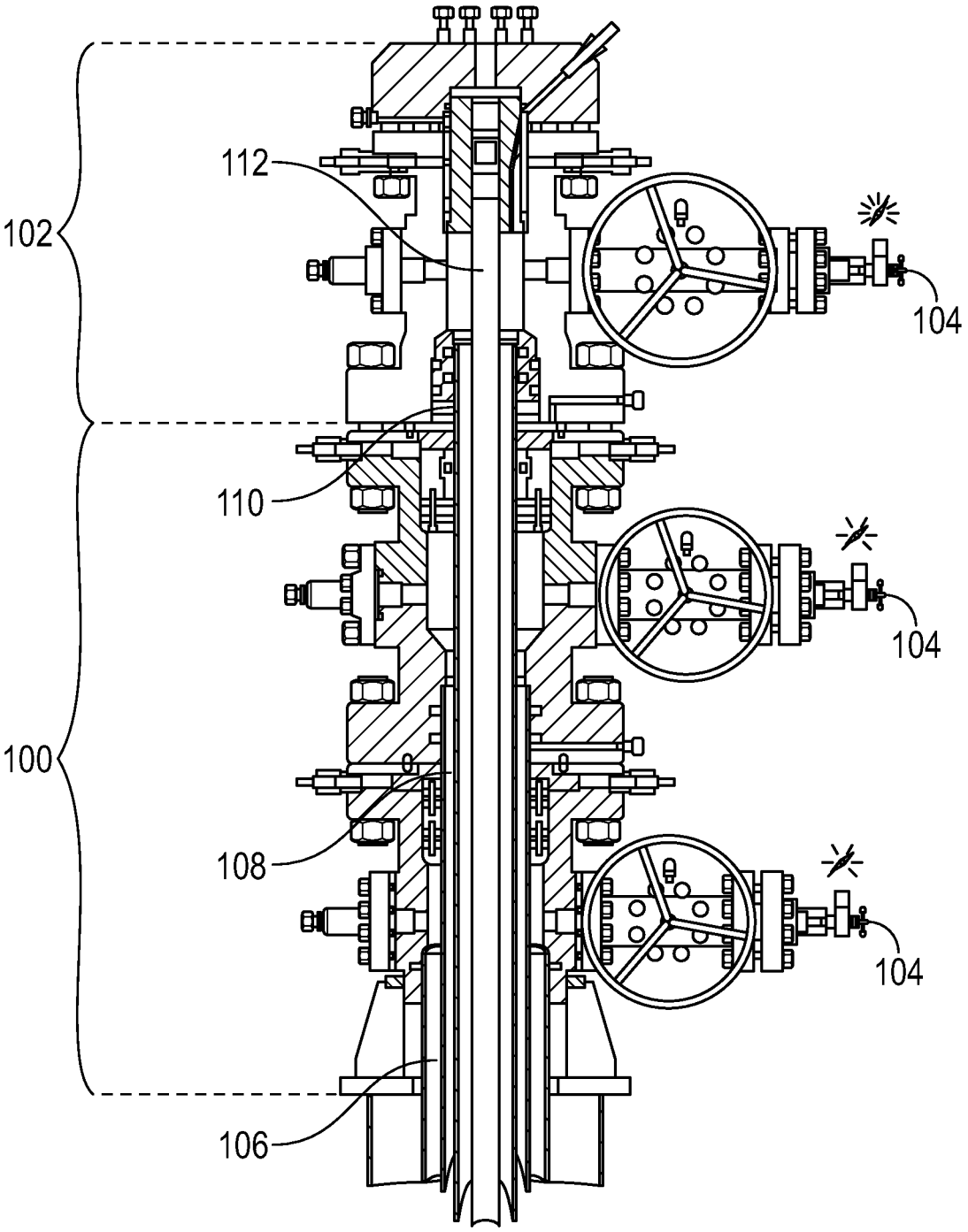
FIG. 1 (Prior Art)
FIG. 1 shows a wellhead and a tubing head in accordance with one or more embodiments.

FIG. 1 depicts a wellhead (100) and a tubing head (102) in accordance with one or more embodiments. The wellhead (100) and the tubing head (102) may be installed at the surface of the Earth and may provide access to a well (not pictured) that has been drilled into the Earth's surface to produce fluids. The wellhead (100) is a combination of spools and valves (104) and is used to drill hole sections and house casing hangers. The wellhead (100) as depicted in FIG. 1 has two valves (104) and houses the casing hangers for a surface casing string (106), an intermediate casing string (108), and a production casing string (110). The valves (104) may be any type of valve known in the art, such as a mechanical gate valve. The valves (104) may be used to access the casing strings (106, 108, 110), and each valve (104) may be the same as or different than each other.

The casing strings (106, 108, 110) are large diameter pipe that are lowered into the well and cemented in place. The casing strings (106, 108, 110) are made of a material, such as steel, that can withstand the temperatures, pressures, and fluids that are present downhole. The casing hangers are the shallow-most portion of each casing string (106, 108, 110) and are designed with various seals and jewelry. Each casing hanger has a corresponding bore located within the wellhead (100). The casing hangers for each casing string (106, 108, 110) are landed out into each corresponding bore in the wellhead (100) such that the weight of each casing string (106, 108, 110) is held up and supported by the wellhead (100).

The tubing head (102), as depicted in FIG. 1, has one valve (104), and houses the tubing hanger for a tubing string (112). The valve (104) may be any type of valve known in the art, such as a mechanical gate valve. The valve (104) may be used to access the tubing string (112). The tubing string (112) is a combination of smaller diameter pipe, jewelry, and various downhole equipment that is used to aid in the production of fluids, such as hydrocarbons, from within the Earth's surface. The tubing string (112) is made of a material, such as steel, that can withstand the temperatures, pressures, and fluids that are encountered downhole.

Common drilling practices do not include drilling the well with the tubing head (102) installed on top of the wellhead (100). The well is drilled through a blow-out preventer (BOP) and the wellhead (100), and the tubing head (102) is installed after the well has been drilled and the casing has been set. This is because the clearances provided in a tubing head (102) for the tubing hanger are of a much smaller diameter than the equipment that needs to be run downhole to drill and complete the various hole sizes, meaning that the equipment can not physically fit through the space allocated in the tubing head (102) for the tubing hanger.

The sequence of drilling the well for which the wellhead (100) and the tubing head (102), as depicted in FIG. 1, are used for may begin with installing the wellhead (100) on the surface of the Earth. A BOP (not pictured) is installed on top of the wellhead (100) to aid in well control. At this point in the sequence, the tubing head is not present, but rather the BOP is connected to the wellhead (100). A drill bit and a drill string are run through the BOP and the wellhead (100) to drill a surface hole section. The surface casing string (106) is run into the surface hole, landed out in the wellhead (100), and cemented in place.

A drill bit smaller than the drill bit used to drill the surface hole section along with a drill string are run through the BOP, the wellhead (100), and the surface casing string (106) to drill an intermediate hole section. The intermediate casing string (108) is run into the intermediate hole, landed out in the wellhead (100), and cemented in place. A drill bit smaller than the drill bit used to drill the surface hole section and the intermediate section along with a drill string are run through the BOP, the wellhead (100), and the intermediate casing string (108) to drill a production hole section. The production casing string (110) is run into the production hole, landed out in the wellhead (100), and cemented in place.

The BOP is removed to install the tubing head (102) on top of the wellhead (100). The BOP is then installed on top of the tubing head (102) and completion operations, including installing the tubing string (112), are performed. In current practice, the tubing head (102) cannot be installed on top of the wellhead (100) until after the various hole sections have been drilled and the casing strings (106, 108, 110) have been run in hole. This is because the clearances currently provided in the available tubing heads (102) are not large enough to fit the various sized drill bits, casing string (106, 108, 110), and other downhole tools that are needed to drill the well. The BOP is required to be used during drilling the well and while installing the tubing string (112) to act as a defense if a well control situation presents.

Because of these factors, the BOP is required to be removed to install the tubing head (102) onto the wellhead (100) and then the BOP is re-installed to complete the well, which requires excess effort and time. Therefore, systems and methods that allow the well to be drilled though the tubing head (102) and prevent the BOP from being removed and re-installed, prior to the well being completed, are beneficial. As such, embodiments disclosed herein present apparatuses and methods that allow for a well to be drilled with a tubing head (102) in place, and the tubing hanger to be landed out, advantageously providing for drilling and completion to proceed without removing the BOP for installation of the tubing head (102).

Figure 2:
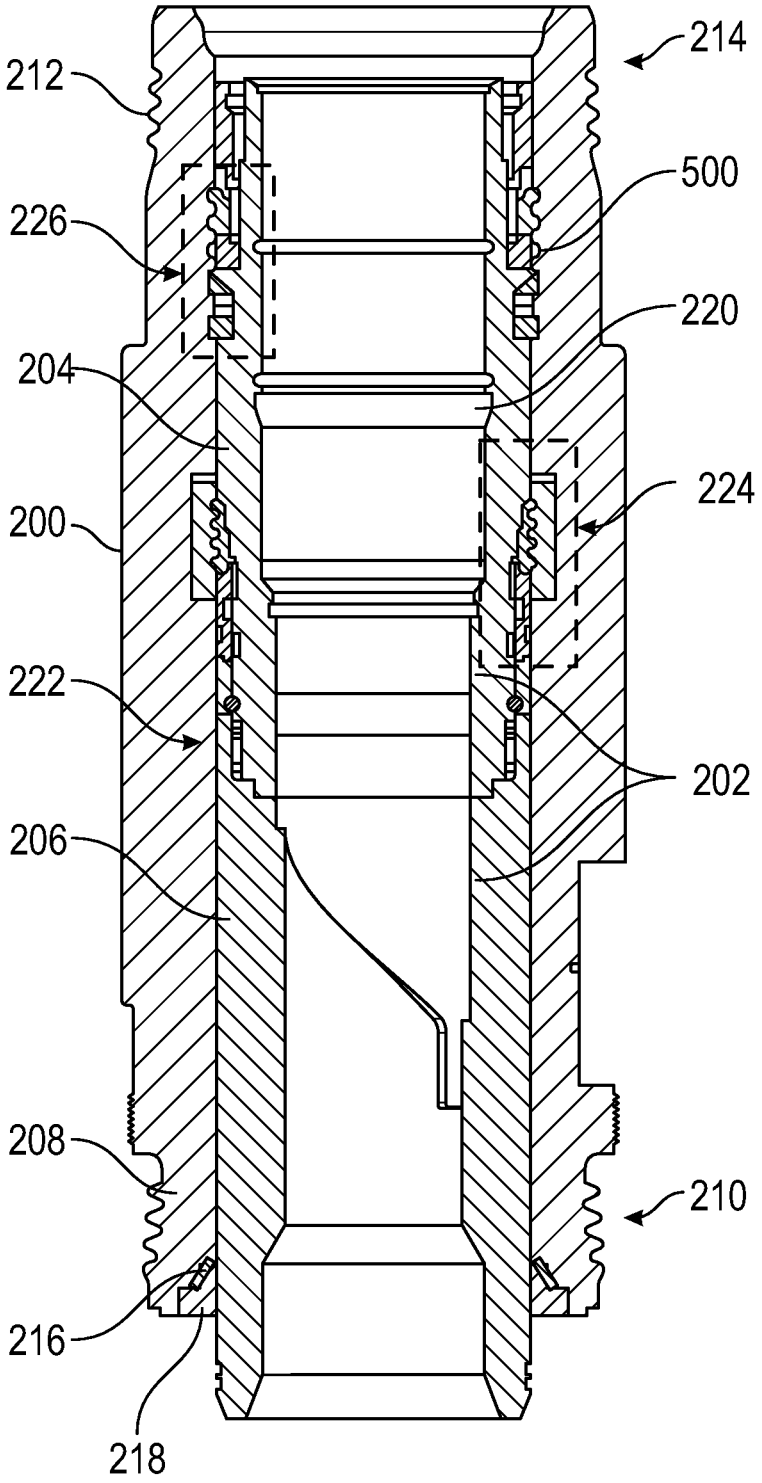
FIG. 2 shows an apparatus in accordance with one or more embodiments.

FIG. 2 shows an apparatus in accordance with one or more embodiments. The apparatus is made of a tubing head spool (200) and a tubing hanger adapter bushing (TAB) (202). The TAB (202) is shown as having an upper portion (an upper TAB (204)) and a lower portion (a lower TAB (206)); however, the TAB (202) may be a singular body (i.e., not formed by two portions) or may be formed with more than two portions. The tubing head spool (200) is made of a tubular body. Meaning the tubing head spool (200) is formed in a tubular shape having a central orifice. The tubular body is made of any durable material, such as steel.

The tubing head spool (200) has a first lateral end (208) that forms a wellhead connection (210) with a wellhead such as the wellhead (100) depicted in FIG. 1. The wellhead connection (210) may be formed by any means known in the art such as threading, sealing, or bolting. The tubing head spool (200) has a second lateral end (212) that forms a BOP connection (214) with a BOP such as the BOP described above. The BOP connection (214) may be formed by any means known in the art such as threading, sealing, or bolting. The tubing head spool (200) has an inner circumferential surface that is designed for various interactions with the TAB (202). The size of the space within the inner circumferential surface of the tubing head spool (200) is large enough to fit any equipment that is required to drill and complete the well for which the tubing head spool (200) and the wellhead (100) are intended to be used.

The first lateral end (208) of the tubing head spool (200) includes a gasket (216) and a gasket lip (218) that are used to seal the wellhead connection (210). The gasket lip (218) includes pins (not pictured) that connect the gasket lip (218) to the body of the tubing head spool (200). The gasket (216) and the gasket lip (218) extend completely around the inner circumferential surface of the first lateral end (208) of the tubing head spool (200). The gasket (216) is around the gasket lip (218) between the gasket lip (218) and the tubing head spool (200). The gasket (216) is the seal within the wellhead connection (210) to prevent fluid from leaking out between the tubing head spool (200) and the wellhead (100).

The tubing head spool (200) (without the TAB (202)) may be installed on the wellhead (100) using the wellhead connection (210). The BOP may be installed on the second lateral end (212) of the tubing head spool (200) using the BOP connection (214). The well may be drilled by running downhole tools, such as a drill bit, drill string, etc., through the BOP, the tubing head spool (200), and the wellhead (100). Casing string(s) such as the casing strings (106, 108, 110) depicted in FIG. 1 may also be installed and cemented through the BOP, the tubing head spool (200), and the wellhead (100). After the well has been drilled and the casing string(s) (106, 108, 110) have been landed out in the wellhead (100) and cemented in place, the TAB (202) may be run through the BOP and installed within the tubing head spool (200).

The TAB (202) is used to land out the tubing hanger of the tubing string (112) as described in FIG. 1. The TAB (202) is a tubular body made of any durable material, such as steel. The TAB (202) has an outer circumferential surface that fits within the tubing head spool (200) and interacts with the inner circumferential surface of the tubing head spool (200). The inside of the TAB (202) has a tubing hanger interface (220) for interaction with the tubing hanger. After the TAB (202) has been installed within the tubing head spool (200), the tubing string (112) may be run into the well and landed out in the tubing hanger interface (220) of the TAB (202). The tubing hanger interface (220) of the TAB (202) may be designed to fit any type of tubing hanger.

As stated previously, the TAB (202) may be made of an upper TAB (204) and a lower TAB (206). The upper TAB (204) and the lower TAB (206) may be assembled together at the surface prior to the TAB (202) being run through the BOP and installed in the tubing head spool (200). In other embodiments, the upper TAB (204) and lower TAB (206) may be individually run through the BOP and installed sequentially in the tubing head spool (200). The upper TAB (204) and the lower TAB (206) are connected through a TAB connection (222). The TAB connection (222) may be formed in some embodiments by threading the upper TAB (204) into the lower TAB (206).

In one or more embodiments, the lower TAB (206) is responsible for rotational orientation (rotation would be as viewed from above) of the TAB (202) into the tubing head spool (200). The outer circumferential surface of the lower TAB (206) contains a profile which may interact or interface with a corresponding profile on the tubing head spool (200). This interaction may occur actively or passively to allow the orientation of the TAB (202) to be locked into place. The inner circumferential surface of the lower TAB (206) contains a machined helix which may interact with a tubing hanger alignment key, setting the orientation of the tubing hanger within the TAB (202).

The upper TAB (204) is responsible for retention of the TAB (202) inside of the tubing head spool (200) and for retention of the tubing hanger within the TAB (202). The TAB (202) contains external components as described below which hold the TAB (202) inside of the tubing head spool (200) securing against upward and downward force. The inner circumferential surface of the TAB (202) includes a profile which accommodates the seals and lock ring of an existing tubing hanger, also securing against upward and downward force.

The external components include a lock ring mechanism (226) and a hang off mechanism (224). The TAB (202) is hung off within the tubing head spool (200) using the hang off mechanism (224). The hang off mechanism (224) allows the combined weight of the TAB (202) and the tubing string (112) to be held up by the tubing head spool (200). The lock ring mechanism (226), which is located between the TAB (202) and the tubing head spool (200), is used to prevent any upward movement of the TAB (202) within the tubing head spool (200) upon complete installation of the TAB (202) within the tubing head spool (200). Portions of the lock ring mechanism (226) and the hang off mechanism (224) may be installed on the upper TAB (204) prior to the lower TAB (206) being connected to the upper TAB (204). This is because the portions of the lock ring mechanism (226) and the hang off mechanism (224) may need to be slid onto the upper TAB (204) and, as these portions cannot fit around the lower TAB (206), they are held in place until installation.

The TAB (202) may require orientation within the tubing head spool (200) while the TAB (202) is being inserted into the tubing head spool (200). Proper orientation may be required to ensure the lock ring mechanism (226) and the hang off mechanism (224) function correctly. Orientation may be performed, in some embodiments, by extending an actuated and retractable pin from the tubing head spool (200) into the lower TAB (206). The pin may be installed within the tubing head spool (200), and the pin may extend from the inner circumferential surface of the tubing head spool (200) into a slot that has been machined into the lower TAB (206). The pin may extend by ¼ inch, for example. As the lower TAB (206) is entering the tubing head spool (200), the TAB (202) may be rotated until the pin enters the slot. The slot may capture the actuated pin and allow for indication of proper orientation via overpull or reduction in hang off weight. In other embodiments, the slot may be located in the upper TAB (204) and the pin may enter the slot from above by lifting the TAB (202). After proper orientation is indicated, the pin may be retracted back into the tubing head spool (200), so the TAB (202) may be fully landed out.

Figure 3B:
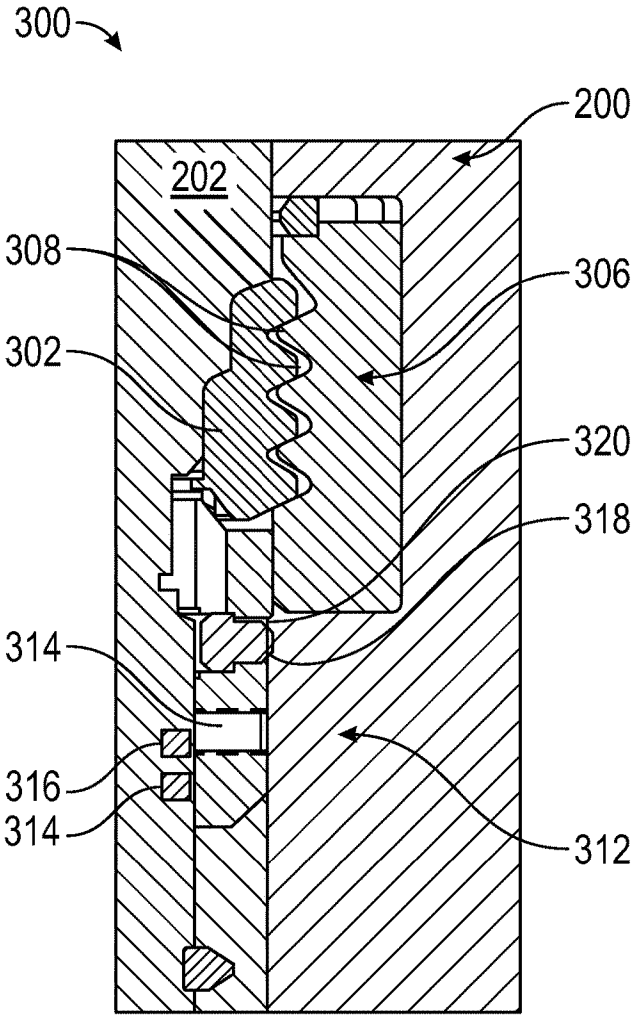
FIGS. 3*a* and 3*b* show a first hang off mechanism in accordance with one or more embodiments.
Figure 3A:
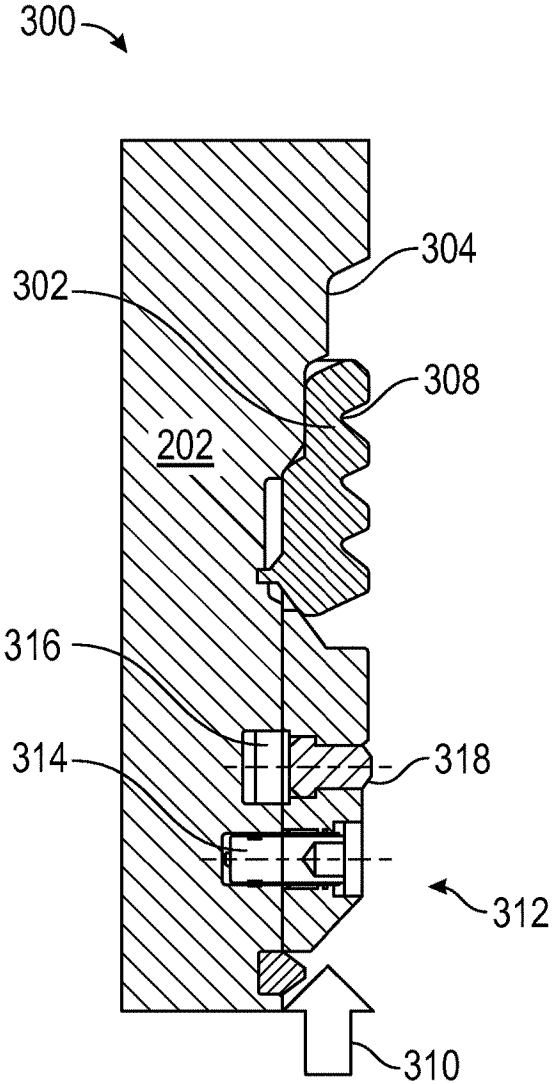
Figure 4B:
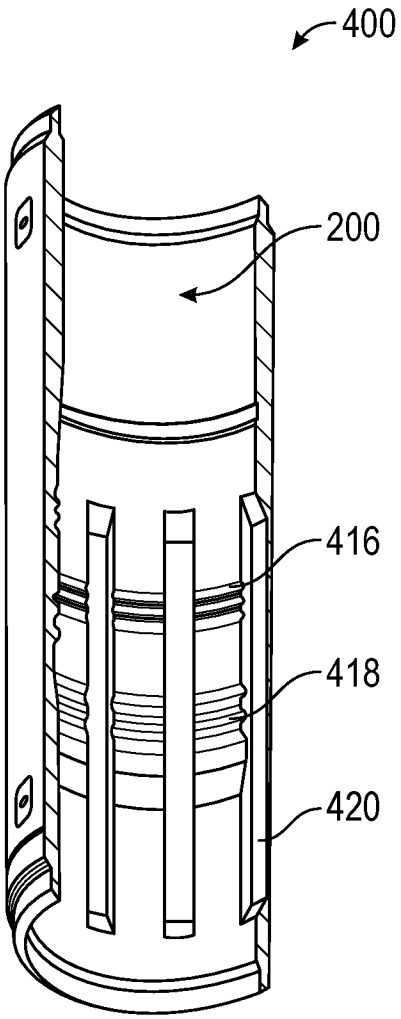
FIGS. 4*a* and 4*b* show a second hang off mechanism in accordance with one or more embodiments.
Figure 4A:
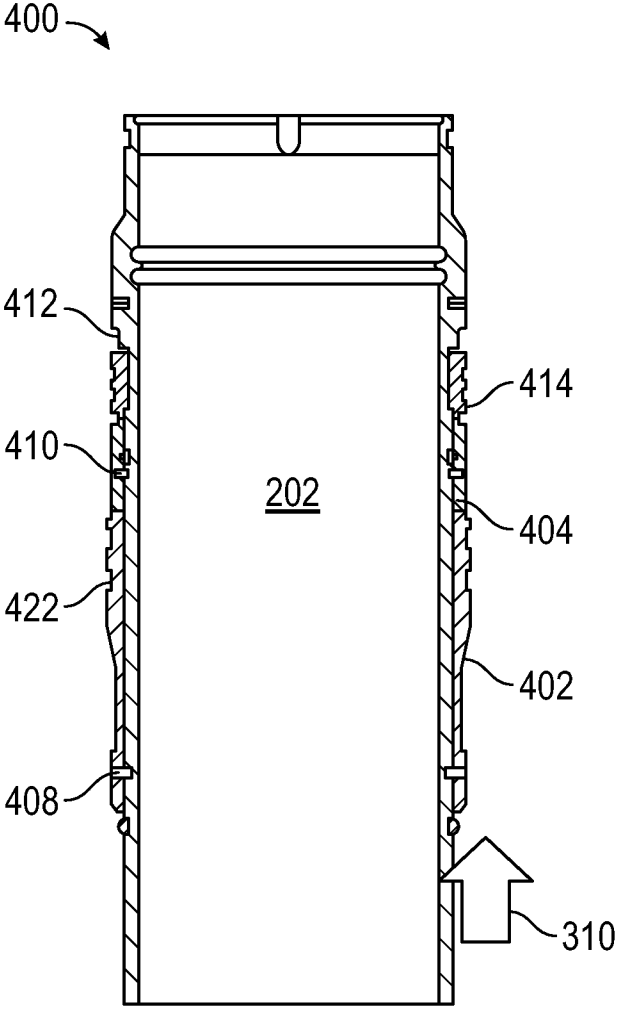

The hang off mechanism (224) may be the first hang off mechanism (300) as depicted in FIGS. 3*a* and 3*b*, or the hang off mechanism (224) may be the second hang off mechanism (400) as depicted in FIGS. 4*a* and 4*b*. Components shown in FIGS. 3*a*, 3*b*, 4*a*, and 4*b* that are the same as or similar to components shown in FIGS. 1 and 2 have not been re-described for purposes of readability and have the same functions as described above. FIG. 3*a* shows the first hang off mechanism (300) in the disengaged position and FIG. 3*b* shows the first hang off mechanism (300) in the engaged position.

The first hang off mechanism (300) includes a hang off ring (302) disposed circumferentially around the outer circumferential surface of the TAB (202). The hang off ring (302) may move from a disengaged position (as shown in FIG. 3*a*) to an engaged position (as shown in FIG. 3*b*). The engaged position is when the hang off ring (302) has moved into the hang off ring profile (304) that is machined into the TAB (202). Further, when the hang off ring (302) is in the hang off ring profile (304), the hang off ring (302) may be inserted into the hang off ring seat (306).

The hang off ring seat (306) is located circumferentially within the inner circumferential surface of the tubing head spool (200). The hang off ring seat (306) may be a separate component having notches (308) that mesh with the notches (308) of the hang off ring (302). The separate component may then be fixed within the tubing head spool (200). In other embodiments, the hang off ring seat (306) and corresponding notches (308) may be machined into the inner circumferential surface of the tubing head spool (200). The notches (308) of the hang off ring seat (306) and the hang off ring (302) interact with one another such that the hang off ring seat (306) holds up the hang off ring (302). Thus, the weight of the TAB (202), and tubing string (112), can be held up within the tubing head spool (200).

The hang off ring (302) enters the engaged position by being pushed in an upward direction (310) by an activation ring (312). An upward direction (310) is a direction starting from the direction of the wellhead (100) moving towards the direction of the BOP. The activation ring (312) is initially held in place by one or a plurality of first shear pins (314) extending from the activation ring (312) into the TAB (202). The first shear pins (314) are designed to shear when a pre-determined force is reached. The activation ring (312) further includes a smart ring (316) having a first shoulder (318). The smart ring (316) is disposed circumferentially around the activation ring (312) and extends partially into the TAB (202). The smart ring (316) responds to a force exerted by the tubing head spool (200). As the TAB (202) is being lowered into the tubing head spool (200), the first shoulder (318) catches on a ledge (320) of the tubing head spool (200). A force is transferred from the tubing head spool (200) to the first shoulder (318). This causes the smart ring (316) to be pushed into the TAB (202) which allows for the force to move the activation ring (312) in the upward direction (310), shear the plurality of first shear pins (314), and push the hang off ring (302) into the hang off ring profile (304) and the hang off ring seat (306).

FIGS. 4*a* and 4*b* depict the second hang off mechanism (400) in accordance with one or more embodiments. The second hang off mechanism (400) may be used as an alternate to the first hang off mechanism (300). The second hang off mechanism (400) includes portions that are installed on the TAB (202) (as shown in FIG. 4*a*) and portions that are machined into the tubing head spool (200) (as depicted in FIG. 4*b*). Specifically, FIG. 4*a* shows the TAB (202) having a crown sleeve (402), a retainer sleeve (404), and a load ring (414) all disposed circumferentially around the outer circumferential surface of the TAB (202).

The crown sleeve (402) includes a plurality of second shear pins (408) that extend from the crown sleeve (402) into the body of the TAB (202) to hold the crown sleeve (402) in place. The plurality of second shear pins (408) are designed to shear when a pre-determined force is reached. The retainer sleeve (404) includes a plurality of third shear pins (410) that are extend from the retainer sleeve (404) into the body of the TAB (202) to hold the retainer sleeve (404) in place. The plurality of third shear pins (410) are designed to shear when a pre-determined force is reached. The second hang off mechanism (400) also includes a load ring profile (412) machined into the TAB (202). The load ring profile (412) is designed such that the load ring (414) may be placed around the load ring profile (412). The tubing head spool (200) is shown having load shoulders (416), landing shoulders (418), and a crown sleeve interface (420) machined into the inner circumferential surface.

FIG. 4*a* shows the second hang off mechanism (400) in the disengaged position. The engaged position of the second hang off mechanism (400) is when the load ring (414) is in the load ring profile (412) of the TAB (202) and in the load shoulders (416) of the tubing head spool (200). The second hang off mechanism (400) enters the engaged position by running the TAB (202) into the tubing head spool (200). The crown sleeve (402) interacts with the crown sleeve interface (420) machined into the tubing head spool (200) to shear the plurality of second shear pins (408) to allow upward movement of the crown sleeve (402).

Specifically, landing rings (422) of the crown sleeve (402) catch on the landing shoulders (418) of the tubing head spool (200). As the weight of the TAB (202) is set on the landing shoulder (418), the second shear pins (408) shear allowing the crown sleeve (402) to move in the upward direction (310) towards the retainer sleeve (404). The force acting on the retainer sleeve (404) causes the third shear pins (410) to shear which allows the retainer sleeve (404) to slide under the load ring (414) to expand the load ring (414) into the load ring profile (412) of the TAB (202). This places the load ring (414) in the load shoulder (416) of the tubing head spool (200). Thus, the weight of the TAB (202), and tubing string (112), can be held up within the tubing head spool (200) using the interaction between the load ring (414) and the load shoulders (416).

Figure 5:
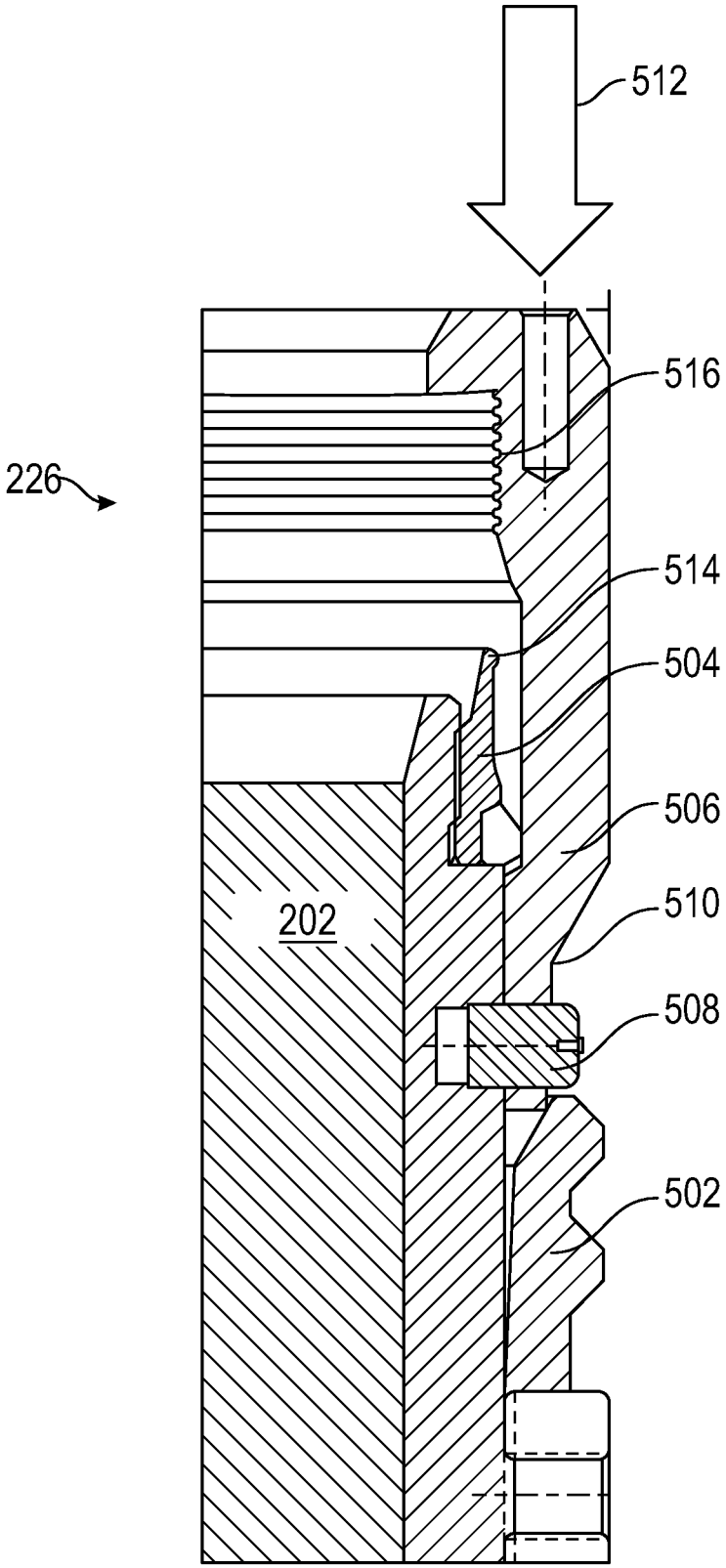
FIG. 5 shows a lock ring mechanism in accordance with one or more embodiments.

FIG. 5 depicts the lock ring mechanism (226) in accordance with one or more embodiments. Components shown in FIG. 5 that are the same as or similar to components shown in FIGS. 1-4*b* have not been re-described for purposes of readability and have the same functions as described above. The lock ring mechanism (226) includes a lock ring interface (500) (shown in FIG. 2) machined into the inner circumferential surface of the tubing head spool (200), a lock ring (502) disposed circumferentially around the outer circumferential surface of the TAB (202), an anti-back off ring (504) disposed circumferentially around the outer circumferential surface of the TAB (202), and a lock mandrel (506) disposed circumferentially around the outer circumferential surface of the TAB (202) and around the anti-back off ring (504).

The lock mandrel (506) extends to the topmost portion of the TAB (202) such that the lock mandrel (506) can be accessed when the TAB (202) is almost completely within the tubing head spool (200). The lock mandrel (506) further includes a plurality of fourth shear pins (508) that extend from the lock mandrel (506) into the TAB (202) to hold the lock mandrel (506) in place. The plurality of fourth shear pins (508) are designed to shear when a predetermined force is reached. The outer circumferential surface of the lock mandrel (506) has a lock ring profile (510) that is designed to seat the lock ring (502). The lock ring mechanism (226) is shown in FIG. 5 in the disengaged position. The lock ring mechanism (226) may be placed in the engaged position by applying a force in the downward direction (512) onto the top of the lock mandrel (506).

The force pressing down on top of the lock mandrel (506) may be applied by a tool used to land the TAB (202) into the tubing head spool (200). As the force presses down on the lock mandrel (506), the plurality of fourth shear pins (508) shear allowing the lock mandrel (506) to slide beneath the lock ring (502), placing the lock ring onto the lock ring profile (510). When this occurs as the TAB (202) is being run into the tubing head spool (200), the lock mandrel (506) sliding beneath the lock ring (502) also places the lock ring (502) into the lock ring interface (500) of the tubing head spool (200). The anti-back off ring (504) has a bump (514) that interacts with the thread profiles (516) of the TAB (202) in response to an upward force to prevent any upward movement of the TAB (202) once the lock ring (502) is in the lock ring interface (500) of the tubing head spool (200).

Figure 6:
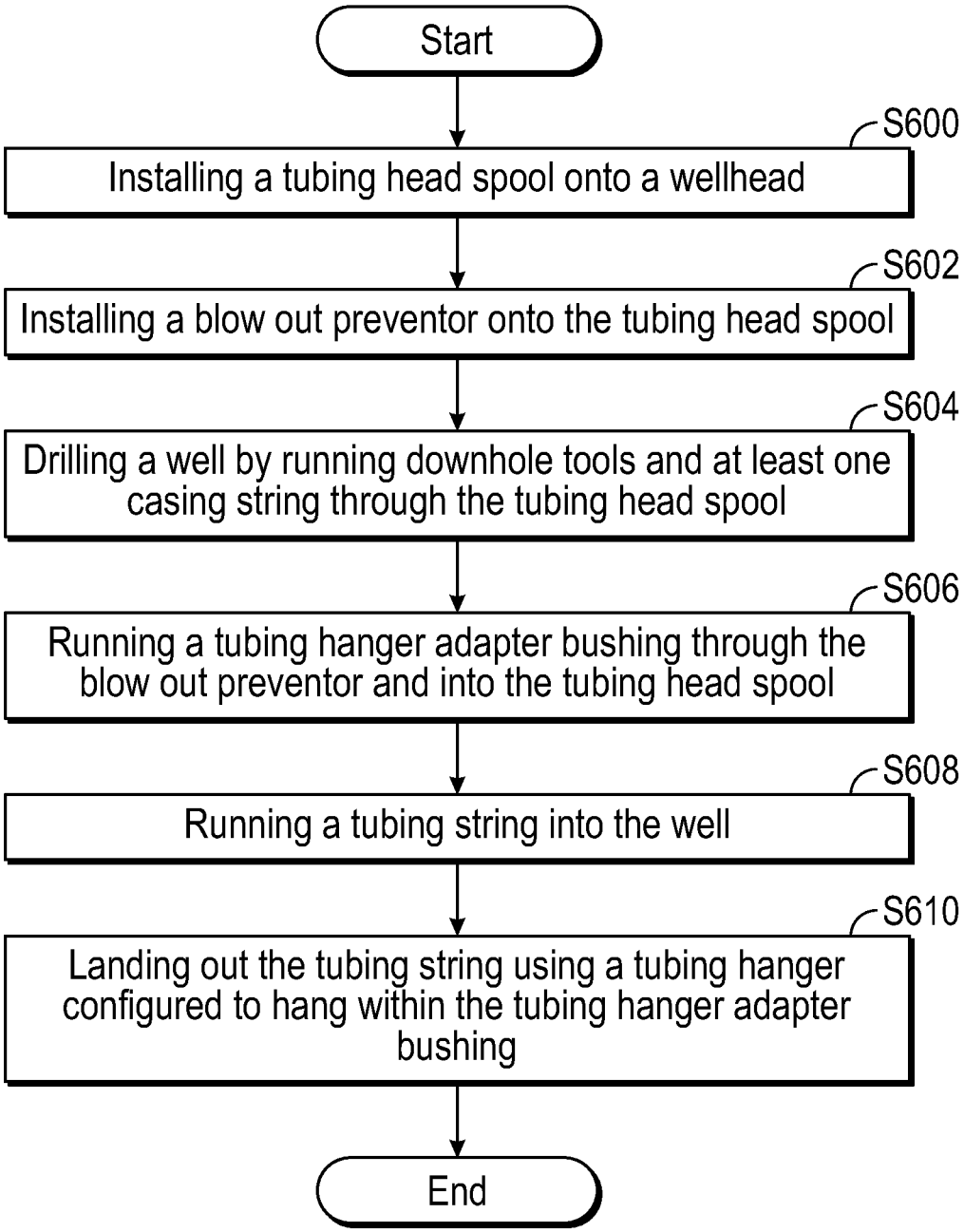
FIG. 6 shows a flowchart in accordance with one or more embodiments.

FIG. 6 shows a flowchart in accordance with one or more embodiments. Specifically, FIG. 6 shows a method for drilling a well through a tubing head spool (200) and a wellhead (100). Further, one or more blocks in FIG. 6 may be performed by one or more components as described in FIGS. 1-5. While the various blocks in FIG. 6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a tubing head spool (200) is installed onto a wellhead (100) (S600) by forming a wellhead connection (210) between the tubing head spool (200) and the wellhead (100). A BOP is installed onto the tubing head spool (200) (S602) by forming a BOP connection (214) between the BOP and the tubing head spool (200). The wellhead connection (210) and the BOP connection may be any type of connection known in the art such as threading and bolting. The size of the wellhead (100) and the size of the space within the tubing head spool (200) are designed to fit the planned well design. A well is drilled by running downhole tools and at least one casing string (106, 108, 110) through the tubing head spool (200) (S604).

After the entirety of the well has been drilled and all of the casings strings (106, 108, 110) have been run into the well and cemented in place, a TAB (202) is run through the BOP and into the tubing head spool (200) (S606). The TAB (202) is hung off within the tubing head spool (200) using a hang off mechanism (224). The hang off mechanism (224) may be the first hang off mechanism (300) as described in FIGS. 3*a* and 3*b*, or the hang off mechanism (224) may be the second hang off mechanism (400) as described in FIGS. 4*a* and 4*b*.

If the first hang off mechanism (300) is in place, then the first shoulder (318) of the smart ring (316) catches on the ledge (320) of the tubing head spool (200) as the TAB (202) is being run into the tubing head spool (200). The smart ring (316) is pushed into the body of the TAB (202) and the first shear pins (314) shear due to the force exerted by the tubing head spool (200) on the TAB (202). The continued application of force by lowering the TAB (202) into the tubing head spool (200) causes the activation ring (312) to move in an upward direction (310) to push the hang off ring (302) into the hang off ring seat (306).

If the second hang off mechanism (400) is in place, then the landing rings (422) of the crown sleeve (402) catch on the landing shoulders (418) of the tubing head spool (200) as the TAB (202) is being lowered into the tubing head spool (200). The force exerted by the landing shoulders (418) onto the landing ring (422) shears the second shear pins (408) allowing the crown sleeve (402) to move in an upward direction (310). The continued exertion of pressure created by lowering the TAB (202) into the tubing head spool (200) pushes the crown sleeve (402) upward into the retainer sleeve, shearing the third shear pins (410). The retainer sleeve (404) is then free to be slipped under the load ring (414) to push the load ring (414) into the load shoulder (416) of the tubing head spool (200).

The TAB (202) is locked into the tubing head spool (200) using the lock ring mechanism (226) described in FIG. 5. After the TAB (202) has been hung off within the tubing head spool (200), the tool that is running the TAB (202) into the well can exert a downward force onto the top of the TAB (202). This downward force acts upon the lock mandrel (506). The fourth shear pins (508) are sheared allowing the downward force to push the lock mandrel (506) under the lock ring (502). This pops the lock ring (502) into the lock ring interface (500) of the tubing head spool (200). With the lock ring (502) in the lock ring interface (500) of the tubing head spool (200), the anti-back off ring (504) prevents the TAB (202) from any upward movement caused by potential kicks of the well.

A tubing string (112) is run into the well (S608) and the tubing string (112) is landed out using a typical tubing hanger that is hung within the TAB (202) (S610). The tubing hanger interface (220) of the TAB (202) is designed with the proper interfaces and sealing surfaces for the tubing hanger that is going to be used. Thus, any type of tubing hanger may be used. Further, any well design may be used with the aforementioned apparatuses as the tubing head spool (200) may be machined to fit all required tools though the inner circumferential surface. Furthermore, the external circumferential surface of the TAB (202) may be expanded to fit within the tubing head spool (200) without effecting the tubing hanger interface (220) and type of tubing hanger that is required for the well plan.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. An apparatus for connection to a wellhead, the apparatus comprising:

a tubing head spool having an inner circumferential surface, a first lateral end that forms a wellhead connection with the wellhead, and a second lateral end;

a tubing hanger adapter bushing with an outer circumferential surface and a tubing head interface, wherein the outer circumferential surface is sized to fit within the tubing head spool;

a first hang off mechanism having a hang off ring seat located circumferentially within the inner circumferential surface of the tubing head spool and a hang off ring disposed circumferentially around the outer circumferential surface of the tubing hanger adapter bushing;

a lock ring mechanism having a lock ring interface machined into the inner circumferential surface of the tubing head spool and a lock ring disposed circumferentially around the outer circumferential surface of the tubing hanger adapter bushing; and an activation ring, having a smart ring and a plurality of first shear pins, disposed circumferentially around the outer circumferential surface of the tubing hanger adapter bushing, wherein the smart ring responds to a force that allows the activation ring to move in an upward direction, shearing the plurality of first shear pins, and pushing the hang off ring into the hang off ring seat.

2. The apparatus of claim 1, further comprising:

a lock mandrel, having a lock ring profile, disposed circumferentially around the outer circumferential surface of the tubing hanger adapter bushing.

3. The apparatus of claim 2, wherein the lock mandrel responds to a downward force to place the lock ring around the lock ring profile which places the lock ring into the lock ring interface of the tubing head spool.

4. The apparatus of claim 3, further comprising:

an anti-back off ring disposed circumferentially around the outer circumferential surface of the tubing hanger adapter bushing.

5. The apparatus of claim 4, wherein the anti-back off ring comprises a bump which interacts with thread profiles in response to an upward force and prevents upward movement of the tubing hanger adapter bushing within the tubing head spool.

6. A method comprising:

installing a tubing head spool onto a wellhead;

installing a blow out preventer onto the tubing head spool;

drilling a well by running downhole tools and at least one casing string through the tubing head spool;

running a tubing hanger adapter bushing through the blow out preventer and into the tubing head spool, wherein the tubing hanger adapter bushing comprises an activation ring and a hang off ring;

running a tubing string into the well; and hanging off the tubing hanger adapter bushing in the tubing head spool by activating the activation ring to push the hang off ring into a hang off ring seat located in the tubing head spool.

7. The method of claim 6, further comprising:

locking the tubing hanger adapter bushing in the tubing head spool using a lock ring mechanism.

8. The method of claim 7, wherein locking the tubing hanger adapter bushing in the tubing head spool using a lock ring mechanism further comprises applying a downward force to shear a plurality of fourth shear pins to place a lock ring into a lock ring interface.

* * * * *